US009320325B2

(12) United States Patent
Chen et al.

(10) Patent No.: US 9,320,325 B2
(45) Date of Patent: Apr. 26, 2016

(54) BELT BUCKLE

(71) Applicant: Racer Sporting Goods Co., Ltd., New Taipei (TW)

(72) Inventors: Shyan-Wei Chen, New Taipei (TW); Ya-Chi Chen, New Taipei (TW)

(73) Assignee: RACER SPORTING GOODS CO., LTD., New Taipei (TW)

( * ) Notice: Subject to any disclaimer, the term of this patent is extended or adjusted under 35 U.S.C. 154(b) by 197 days.

(21) Appl. No.: 14/291,079

(22) Filed: May 30, 2014

(65) Prior Publication Data

US 2015/0342306 A1 Dec. 3, 2015

(51) Int. Cl.

| | |
|---|---|
| ***A44B 11/24*** | (2006.01) |
| ***A44B 11/00*** | (2006.01) |
| ***A44B 11/12*** | (2006.01) |

(52) U.S. Cl.

CPC ..... *A44B 11/12* (2013.01); *A44B 11/006* (2013.01); *A44B 11/24* (2013.01); *Y10T 24/3413* (2015.01); *Y10T 24/4016* (2015.01); *Y10T 24/4056* (2015.01); *Y10T 24/4736* (2015.01)

(58) Field of Classification Search

CPC .... A44B 11/006; A44B 11/12; A44B 11/008; A44B 11/24; Y10T 24/3413; Y10T 24/4016; Y10T 24/4736

IPC ..... A44B 11/006,11/12, 11/008, 11/24; Y10T 24/4736, 24/4016, 24/3413, 24/4056

See application file for complete search history.

(56) References Cited

U.S. PATENT DOCUMENTS

| | | | | |
|---|---|---|---|---|
| 1,775,137 | A * | 9/1930 | Ostrower | A44B 11/24 24/265 BC |
| 4,281,440 | A * | 8/1981 | Britz | A44B 11/006 24/191 |
| 8,522,728 | B2 * | 9/2013 | Davis, Jr. | A44B 11/12 24/170 |
| 2006/0070214 | A1 * | 4/2006 | Hsu | A44B 11/12 24/170 |
| 2010/0205789 | A1 * | 8/2010 | Labelson | A44B 11/006 24/458 |

* cited by examiner

*Primary Examiner* — Robert J Sandy

(74) *Attorney, Agent, or Firm* — Jackson IPG PLLC; Demian K. Jackson

(57) ABSTRACT

A belt buckle includes a buckle base having a plurality of raised portions at a base panel thereof for engagement with the bottom wall of the belt, a clamping plate pivotally connected to the buckle base and having a series of teeth for engagement with the top wall of the belt, a frame member pivotally connected to the buckle base, and a prong member pivotally coupled to the frame member.

3 Claims, 4 Drawing Sheets

BELT BUCKLE

BACKGROUND OF THE INVENTION

1. Field of the Invention

The present invention relates to buckle technology, and more particularly, to a belt buckle, which comprises a buckle base having a plurality of raised portions at a base panel thereof for engagement with the bottom wall of the belt, a clamping plate pivotally connected to the buckle base and having a series of teeth for engagement with the top wall of the belt, a frame member pivotally connected to the buckle base, and a prong member pivotally coupled to the frame member.

2. Description of the Related Art

A conventional belt buckle generally has a clamping plate pivotally connected to a buckle base thereof and adapted for securing a belt to the buckle base. After insertion of one end of the belt in between the clamping plate and the buckle base, the clamping plate is biased toward the buckle base to force a series of teeth thereof into engagement with the top wall of the belt against the buckle base. However, because the clamping plate simply engages the top wall of the belt, the belt can easily be forced by an external force to displace relative to the buckle base or to disconnect from the buckle base. Further, if the belt is too thick or too thin, a different belt buckle may have to be used. Further, conventional belt buckles cannot fit different belts of different materials perfectly.

SUMMARY OF THE INVENTION

The present invention has been accomplished under the circumstances in view. It is the main object of the present invention to provide a belt buckle, which comprises a buckle base having a plurality of raised portions at a base panel thereof for engagement with the bottom wall of the belt, a clamping plate pivotally connected to the buckle base and having a series of teeth for engagement with the top wall of the belt, a frame member pivotally connected to the buckle base, and a prong member pivotally coupled to the frame member. Thus, by means of forcing the raised portions of the buckle base and the series of teeth of the clamping plate into engagement with the opposing top wall and bottom wall of the belt, the belt buckle and the belt are firmly secured together, avoiding accidental disconnection.

It is another object of the present invention to provide a belt buckle, which is selectively mountable with one of various belts having different thicknesses.

It is still another object of the present invention to provide a belt buckle, which is selectively mountable with one of various belts made of different materials.

It is the still another object of the present invention to provide a belt buckle, which is selectively mountable with one of various belts that are made of different materials and have different thickness, and thus, the invention can save inventory and delivery costs, facilitating product management.

It is still another object of the present invention to provide a belt buckle adapted for selling with a belt of a predetermined length so that the consumer can cut the belt to the desired length and then conveniently fastened to the belt buckle, and thus, the invention enables retailers to simplify their stocking and to facilitate their sale.

DETAILED DESCRIPTION OF THE INVENTION

Figure 1:
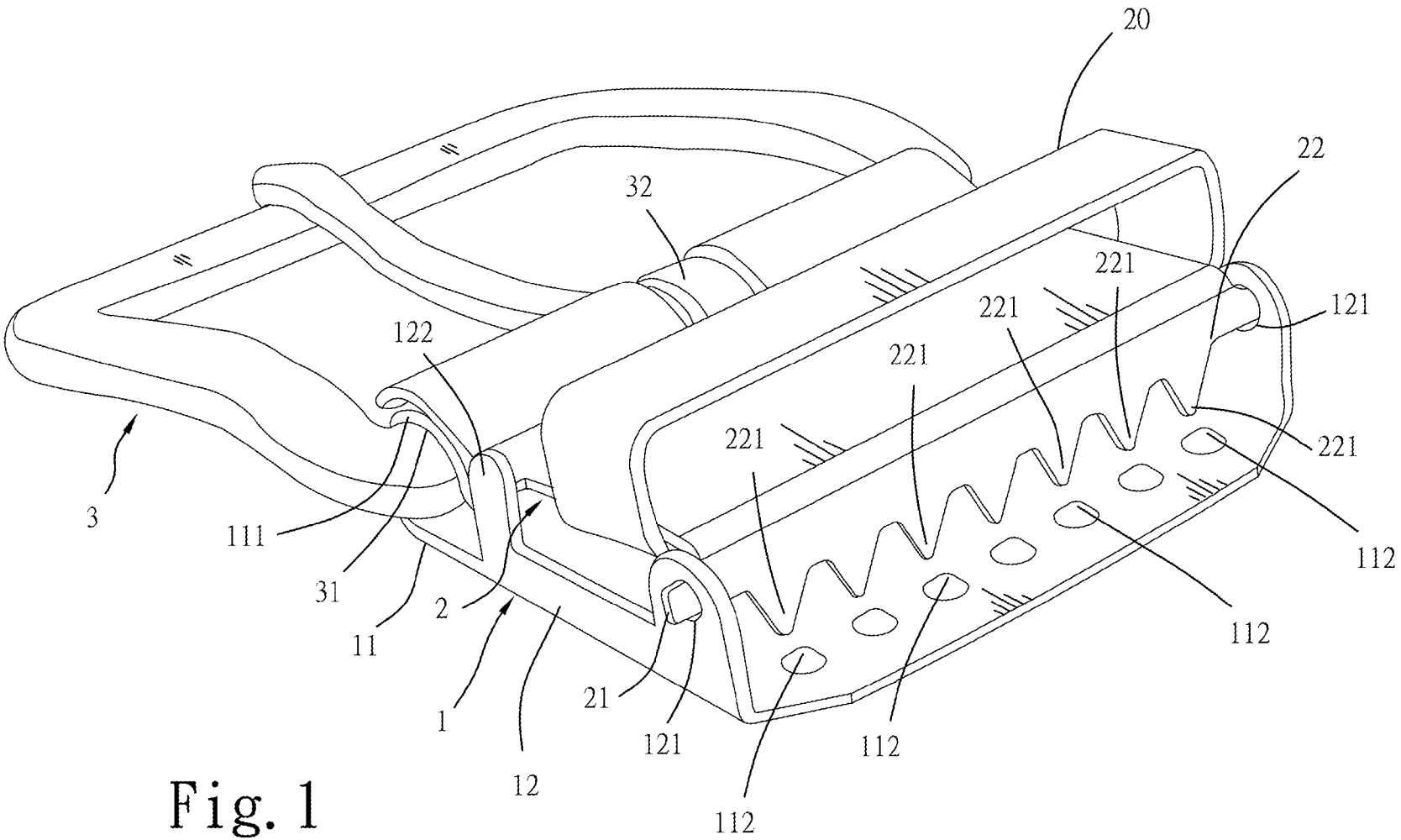
FIG. 1 is an oblique top elevational view of a belt buckle in accordance with the present invention.
Figure 2:
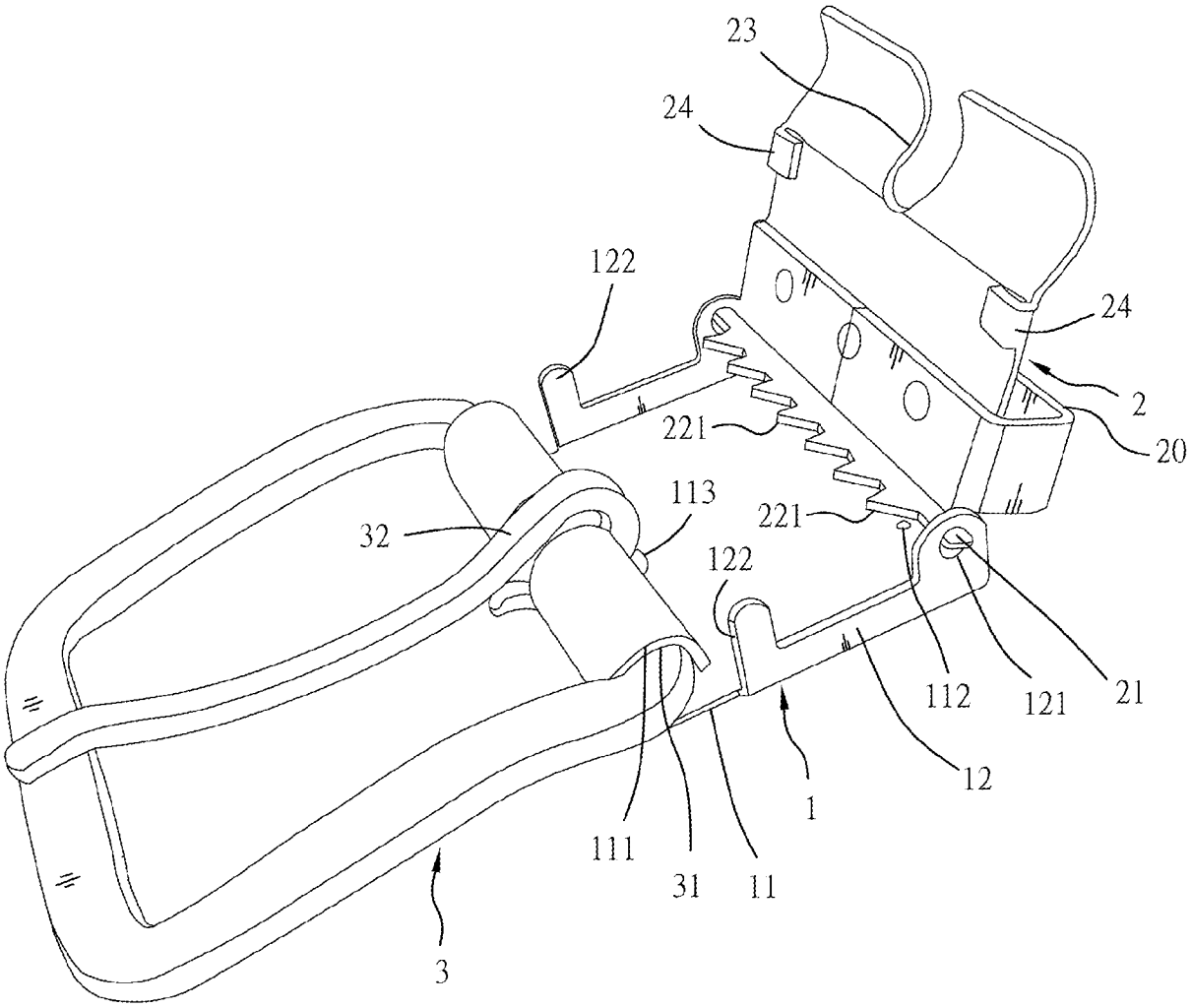
FIG. 2 is an elevational view of the present invention, illustrating the clamping plate turned in direction away from the buckle base.
Figure 3:
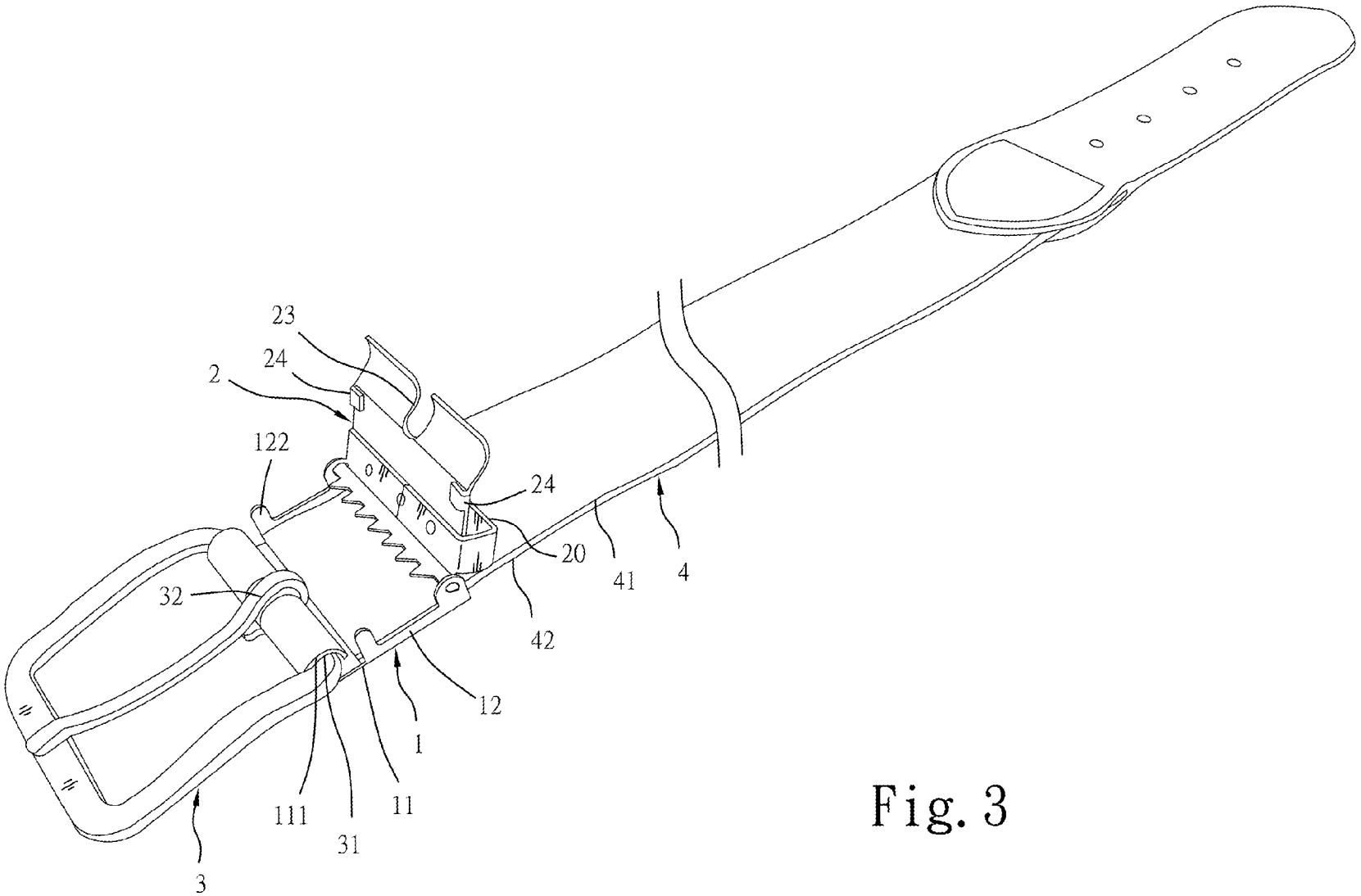
FIG. 3 is a schematic applied view of the present invention, illustrating the belt inserted in between the base panel of the buckle base and the angled plate of the clamping plate.
Figure 4:
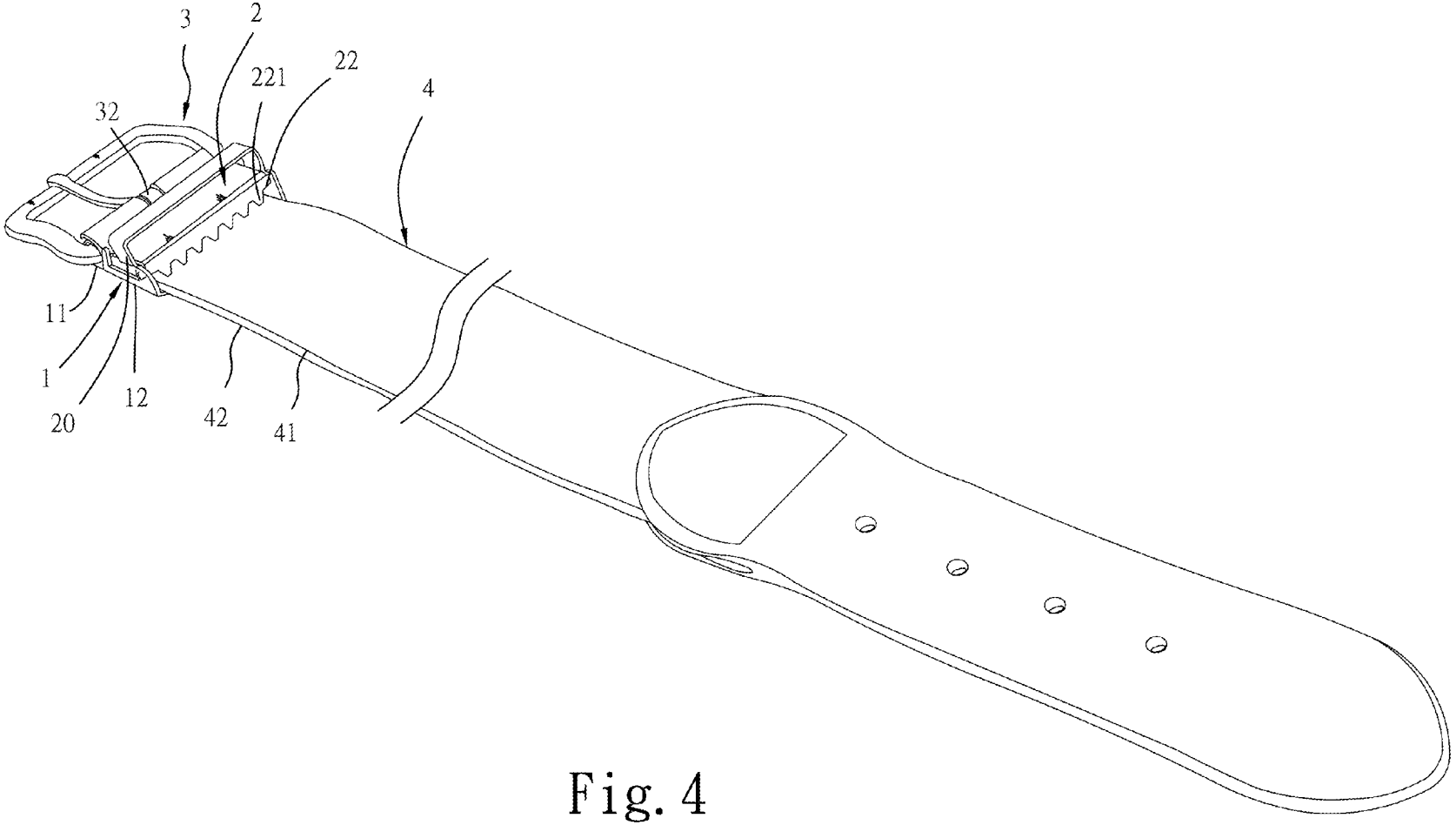
FIG. 4 corresponds to FIG. 3, illustrating the clamping plate clamped on the belt.

Referring to FIGS. 1-4, a belt buckle in accordance with the present invention is shown. The belt buckle comprises:

a buckle base 1 comprising a base panel 11, two upright side panel 12 respectively located at two opposite lateral sides of the base panel 11, a plurality of raised portion 112 located at a top surface of the base panel 11 for friction engagement with a bottom wall 42 of the belt 4 (see FIG. 3), a first pivot connection portion 111 located at a front side of the base panel 11 for the connection of a frame member 3, two second pivot connection portion 121 respectively located at the upright side panels 12 at a rear side for the connection of a clamping plate 2 (see FIG. 1 and FIG. 2), and a notch 113 located in a middle part of an opposing front side of the base panel 11 (see FIG. 2);

a clamping plate 2 comprising two third pivot connection portions 21 bilaterally disposed at a rear side thereof and respectively pivotally coupled to the second pivot connection portions 121 at the upright side panels 12 of the buckle base 1, a belt keeper 20 disposed adjacent to the third pivot connection portions 21, an angled plate 22 extended from the rear side thereof at right angles and terminating in a series of teeth 221 for engaging an opposing top wall 41 of the belt 4 (see FIG. 3), and a notch 23 located in a middle part of an opposing front side thereof;

a frame member 3 having a rear bar 31 transversely located at a rear side thereof and pivotally coupled to the first pivot connection portion 111 of the base panel 11 of the buckle base 1; and a prong member 32 pivotally coupled to the rear bar 31 of the frame member 3.

In application, insert one end of the belt 4 in between the base panel 11 of the buckle base 1 and the angled plate 22 of the clamping plate 2 to a predetermined distance, and then bias the clamping plate 2 toward the base panel 11 to force the series of teeth 221 of the angled plate 22 of the clamping plate 2 into engagement with the top wall 41 of the belt 4 and the raised portions 112 into engagement of the bottom wall 42 of the belt 4. Because the top wall 41 and bottom wall 42 of the belt 4 are respectively kept in engagement with the series of teeth 221 of the angled plate 22 of the clamping plate 2 and the raised portion 112 of the base panel 11, the belt 4 and the buckle base 1 are firmly secured together. The belt buckle of the invention can be selectively used with belts 4 made of different materials and having different thicknesses. Thus, the invention can save inventory and delivery costs, facilitating product management. Further, the invention enables retailers to simplify their stocking and to facilitate their sale.

Further, the buckle base 1 comprises two springy retaining portions 122 respectively located at the upright side panels 12 at an opposing front side (see FIG. 2) for engagement with respective mating retaining portions 24 at two opposite lateral sides of the clamping plate 2.

In conclusion, the invention provides a belt buckle that has advantages and features as follows:

1. By means of forcing the raised portions 112 of the buckle base 1 and the series of teeth 221 of the clamping plate 2 into engagement with the opposing top wall 41 and bottom wall 42 of the belt 4, the belt buckle and the belt 4 are firmly secured together, avoiding accidental disconnection.

2. The belt buckle can be selectively with belts 4 having different thicknesses.
3. The belt buckle can be selectively with belts 4 made of different materials.
4. Because the belt buckle of the invention can be selectively used with belts made of different materials and having different thicknesses, the invention can save inventory and delivery costs, facilitating product management.
5. The invention enables retailers to simplify their stocking and to facilitate their sale.

What is claimed is:

1. A belt buckle, comprising:

a buckle base comprising a base panel, two upright side panels respectively located at two opposite lateral sides of said base panel, a plurality of raised portions located at a top surface of said base panel for friction engagement with a bottom wall of a belt, a first pivot connection portion located at a front side of said base panel for the connection of a frame member, and two second pivot connection portions respectively located at the upright side panels at a rear side for the connection of a clamping plate;

a clamping plate comprising two third pivot connection portions bilaterally disposed at a rear side thereof and respectively pivotally coupled to said second pivot connection portions at said upright side panels of said buckle base, a belt keeper disposed adjacent to said third pivot connection portions, and an angled plate extended from the rear side thereof at a right angle and terminating in a series of teeth for engaging an opposing top wall of said belt;

a frame member comprising a rear bar transversely located at a rear side thereof and pivotally coupled to said first pivot connection portion of said base panel of said buckle base; and a prong member pivotally coupled to said rear bar of said frame member.

2. The belt buckle as claimed in claim 1, wherein said buckle base further comprises two springy retaining portions respectively located at said upright side panels at an opposing front side; said clamping plate further comprises two mating retaining portions located at two opposite lateral sides thereof for engagement with said springy retaining portions of said buckle base.

3. The belt buckle as claimed in claim 2, wherein said buckle base further comprises a notch located in a middle part of an opposing front side of said base panel; said clamping plate further comprises a notch located in a middle part of an opposing front side thereof.

* * * * *